US011639611B2

(12) United States Patent
Pescovitz

(10) Patent No.: US 11,639,611 B2
(45) Date of Patent: May 2, 2023

(54) PERSONAL POP-UP PODS

(71) Applicant: Under the Weather, LLC, Cincinnati, OH (US)

(72) Inventor: Eric Frank Pescovitz, Cincinnati, OH (US)

(73) Assignee: Under the Weather, LLC, Cincinnati, OH (US)

( * ) Notice: Subject to any disclaimer, the term of this patent is extended or adjusted under 35 U.S.C. 154(b) by 0 days.

(21) Appl. No.: 17/151,448

(22) Filed: Jan. 18, 2021

(65) Prior Publication Data

US 2022/0228396 A1 Jul. 21, 2022
US 2023/0093776 A9 Mar. 23, 2023

Related U.S. Application Data

(63) Continuation of application No. 16/394,622, filed on Apr. 25, 2019, now Pat. No. 10,895,091.

(60) Provisional application No. 62/662,445, filed on Apr. 25, 2018, provisional application No. 62/821,415, filed on Mar. 20, 2019.

(51) Int. Cl.
*E04H 15/02* (2006.01)
*E04H 15/40* (2006.01)
*A41D 13/00* (2006.01)

(52) U.S. Cl.
CPC ..... *E04H 15/02* (2013.01); *A41D 13/0002* (2013.01); *E04H 15/405* (2013.01)

(58) Field of Classification Search
CPC ..... E04H 15/001; E04H 15/58
USPC ..... 135/126
See application file for complete search history.

(56) References Cited

U.S. PATENT DOCUMENTS 1,888,909 A * 11/1932 Crosthwait ..... A45B 11/02 224/187
3,546,708 A * 12/1970 Chapman ..... A41D 3/08 2/89
4,685,728 A * 8/1987 Rebollo ..... A47C 4/54 297/184.14
5,101,513 A * 4/1992 Bowers ..... A41D 3/08 2/216
6,305,396 B1 * 10/2001 Zheng ..... A63B 9/00 135/115
6,658,665 B2 * 12/2003 Dodge ..... A41D 3/08 2/84
7,004,539 B1 * 2/2006 Hansen ..... A45B 23/00 135/117
7,137,399 B1 * 11/2006 Ransom ..... E04H 15/32 135/128

(Continued)

FOREIGN PATENT DOCUMENTS

EP 3354822 A2 * 8/2018 ..... E04H 15/58

*Primary Examiner* — Noah Chandler Hawk
(74) *Attorney, Agent, or Firm* — Wood Herron & Evans LLP

(57) ABSTRACT

Disclosed herein are novel personal pop-up pods designed for a single user. The personal pop-up pods can provide a user with privacy and/or protection from the surrounding elements. The personal pop-up pods are designed such that a user can remain mobile, i.e., able to move from one location to another while using a personal pop-up pod. The personal pop-up pods are designed such that a user can selectively gain access to the area surrounding the pop-up pod by opening windows and other points of access.

18 Claims, 25 Drawing Sheets

(56) References Cited

U.S. PATENT DOCUMENTS

| | | | | |
|---|---|---|---|---|
| 8,990,967 | B2 * | 3/2015 | Tallon | A45F 3/02 2/89 |
| 9,060,613 | B2 * | 6/2015 | Combs | A47C 7/0213 |
| 9,907,370 | B2 * | 3/2018 | Huddleston | A45B 23/00 |
| 10,323,435 | B2 * | 6/2019 | Ferrara | E04H 15/64 |
| 2003/0037362 | A1 * | 2/2003 | Dodge | A41D 3/08 2/69 |
| 2004/0159347 | A1 * | 8/2004 | Brown | E04H 15/40 135/125 |
| 2004/0226597 | A1 * | 11/2004 | McCampbell | E04H 15/003 135/117 |
| 2004/0255526 | A1 * | 12/2004 | Tremblay | A01K 97/01 52/79.5 |
| 2006/0169309 | A1 * | 8/2006 | Brackins | E04H 15/32 135/119 |
| 2011/0174811 | A1 * | 7/2011 | Sabounjian | D06F 95/002 220/9.2 |
| 2016/0074268 | A1 * | 3/2016 | Breegi | A61G 11/009 600/21 |

* cited by examiner

PERSONAL POP-UP PODS

CROSS-REFERENCE TO RELATED APPLICATIONS

This application claims priority to pending U.S. Patent Application No. U.S. Ser. No. 16/394,622, titled "Personal Pop-Up Pods," which claims priority to Provisional Patent Application Ser. No. 62/662,445, titled "Personal Pop-Up Pods," filed on Apr. 25, 2018, and U.S. Provisional Patent Application Ser. No. 62/821,415, titled "Personal Pop-Up Pods," filed on Mar. 20, 2019, each of which is expressly incorporated by reference herein in its entirety.

FIELD OF INVENTION

The present disclosure generally relates to personal pop-up pods. More specifically, the present disclosure relates to pop-up pods that accommodate a single user, which allows the user to remain mobile while protecting the user from the elements or providing privacy for the user.

SUMMARY

Disclosed herein are novel personal pop-up pods designed for a single user. The personal pop-up pods can provide a user with privacy and/or protection from the surrounding elements. The personal pop-up pods are designed such that a user can remain mobile, i.e., able to move from one location to another while using a personal pop-up pod. The personal pop-up pods are designed such that a user can selectively gain access to the area surrounding the pop-up pod by opening windows and other points of access.

BRIEF DESCRIPTION OF THE DRAWINGS

In the accompanying drawings, structures are illustrated that, together with the detailed description provided below, describe example embodiments of the disclosed systems, methods, and apparatus. Where appropriate, like elements are identified with the same or similar reference numerals. Elements shown as a single component can be replaced with multiple components. Elements shown as multiple components can be replaced with a single component. The drawings may not be to scale. The proportion of certain elements may be exaggerated for the purpose of illustration.

DETAILED DESCRIPTION

Figure 1:
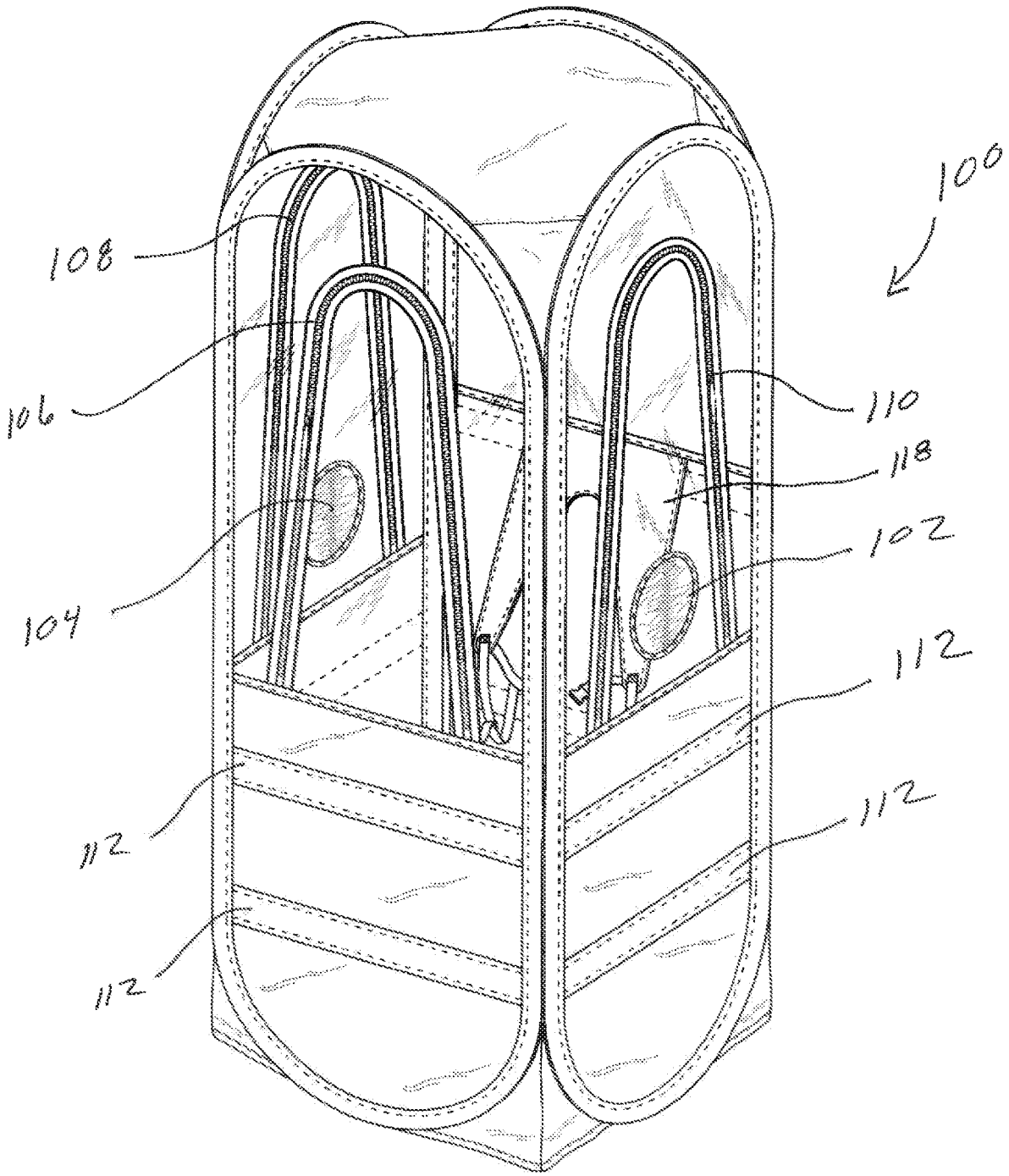
FIG. 1 schematically illustrates a perspective view of a personal pop-up pod.

The apparatus, systems, arrangements, and methods disclosed in this document are described in detail by way of examples and with reference to the figures. It will be appreciated that modifications to disclosed and described examples, arrangements, configurations, components, elements, apparatus, methods, materials, etc. can be made and may be desired for a specific application. In this disclosure, any identification of specific techniques, arrangements, method, etc. are either related to a specific example presented or are merely a general description of such a technique, arrangement, method, etc. Identifications of specific details or examples are not intended to be and should not be construed as mandatory or limiting unless specifically designated as such. Selected examples of apparatus, arrangements, and methods for using a personal pop-up pods are hereinafter disclosed and described in detail with reference made to FIGS. 1-26.

Disclosed herein are novel personal pop-up pods designed for a single user, which can provide the user with protection from the surrounding elements while allowing the user to remain mobile, i.e., allow the user to move from location to location by walking, jogging or any other common mobile methods. In addition, the pop-up pod can include safety features, that will be subsequently described, to offer protection to the user. In summary, the personal pop-up pods disclosed herein are designed for various purposes. For example, the personal pop-up pod can be used by a worker that is required to work outside in the elements such as a crossing guard, a security guard, a laborer, a fast-food worker delivery meals purchased at a drive through window, and many other circumstances. The personal pop-up pod can also be used for practical or recreation purposes to protect a user against inclement weather. For example, a user that enjoys walking or jogging can use a personal pop-up pod in inclement weather to enjoy this recreational pastime. In the spring, an avid gardener may be able to more consistently enjoy that activity with the use of a personal pop-up pod. A student that needs to await a bus to transport the student to school can use a personal pop-up pod while awaiting the bus. It will be understood that these are mere examples of the myriad of uses for personal pop-up pods as disclosed herein.

As schematically illustrated in FIGS. 1-8, a personal pop-up pod 100 can be designed with four sides (e.g., a front side, a rear side, a left side, and a right side), a top and a bottom. The four sides, top, and bottom can be a combination of clear and opaque materials. Two of the sides, such as the left side and right side, can include arm holes 102 and 104 that provides the user of the personal pop-up pod 100 with the opportunity to extend his or her arms outside the personal pop-up pod 100 when the personal pop-up pod 100 is carried by a user. Multiple sides (such as the front side, left side, and right side) can include zippers 106, 108, and 110 that can be zipped and unzipped and allow a flap of material to be moved to either expose or seal the inside of the personal pop-up pod 100 from the surrounding environment. It will be understood that one or more of the zippers 106, 108, and 110 can be unzipped at the user's discretion to configure the personal pop-up pod 100 to suit the user's needs for access to the environment surrounding the user and the personal pop-up pod.

The personal pop-up pod 100 can include a series of safety features such as reflective tape 112 that will visually alert those around the user of the personal pop-up pod 100 of the presence of the user. It will be understood that if the personal pop-up pod 100 is used for a potentially dangerous task such as a police officer directing traffic, a parking lot attendant surveying a parking lot, or a jogger jogging along a roadway, the reflective tape 112 will reflect the headlights of oncoming vehicles and greatly increase the chances of drivers seeing the user and thus, greatly decreasing the chances of an accident involving the user. The material used for the side, top and bottom panels can be constructed of brightly colored material to add additional safety to the use of the personal pop-up pod.

Figure 2:
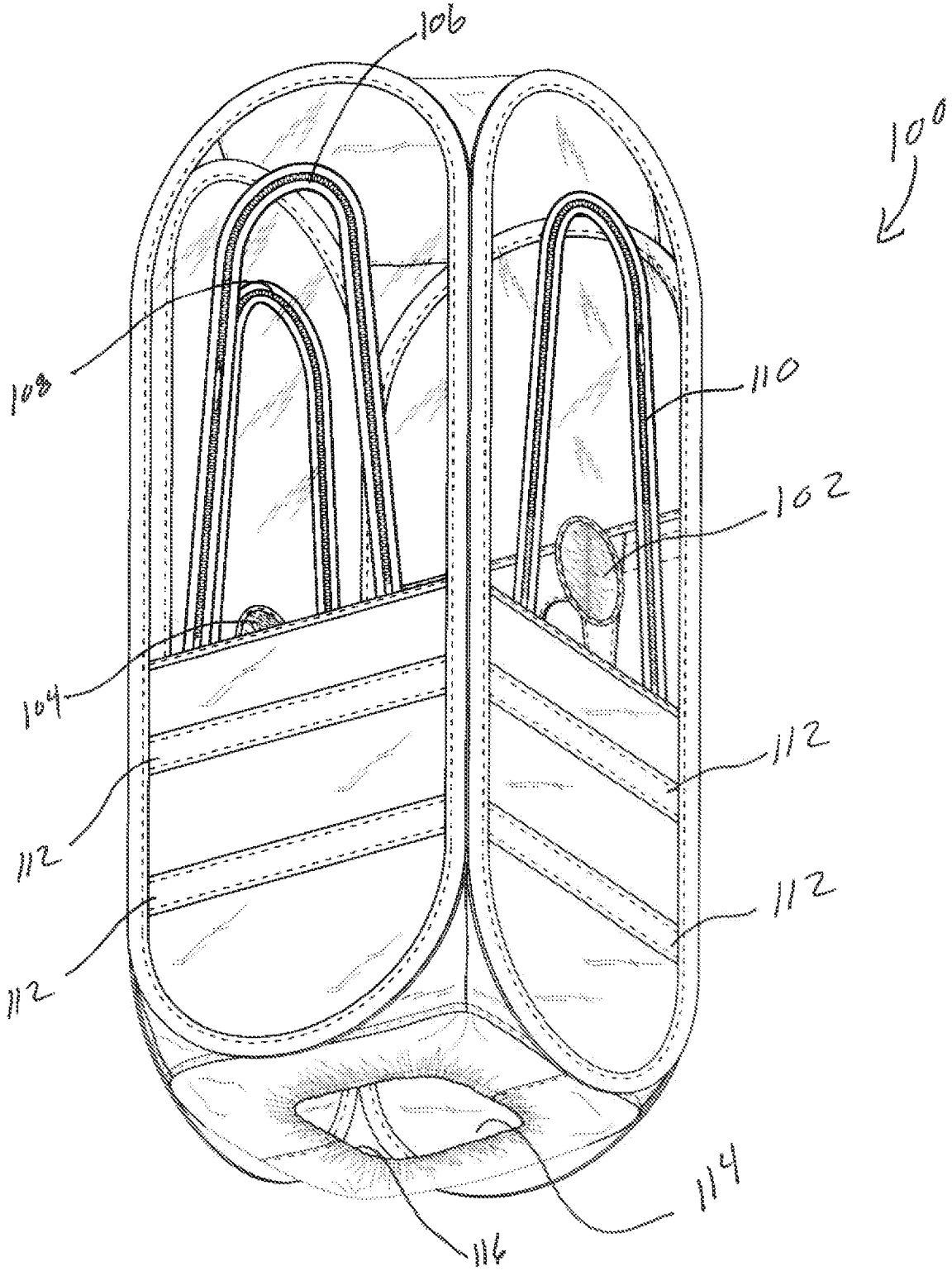
FIG. 2 schematically illustrates another perspective view of the personal pop-up pod of FIG. 1.
Figure 8:
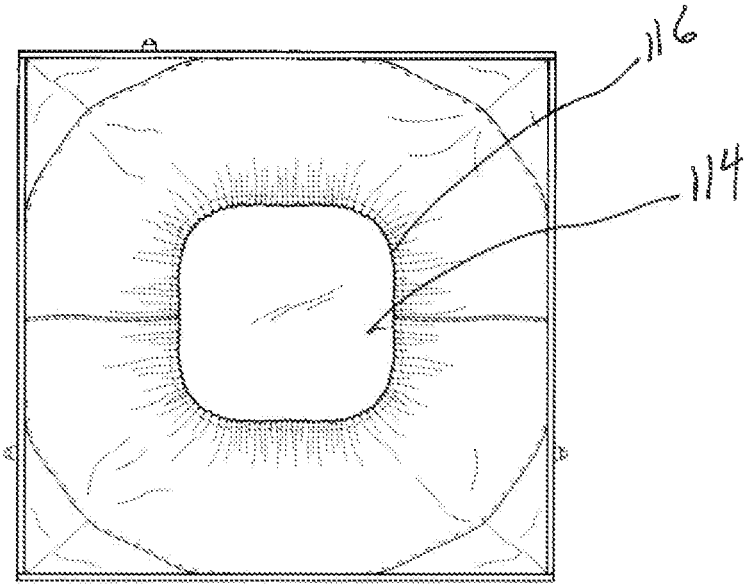
FIG. 8 schematically illustrates a bottom view of the personal pop-up pod of FIG. 1.
Figure 9:
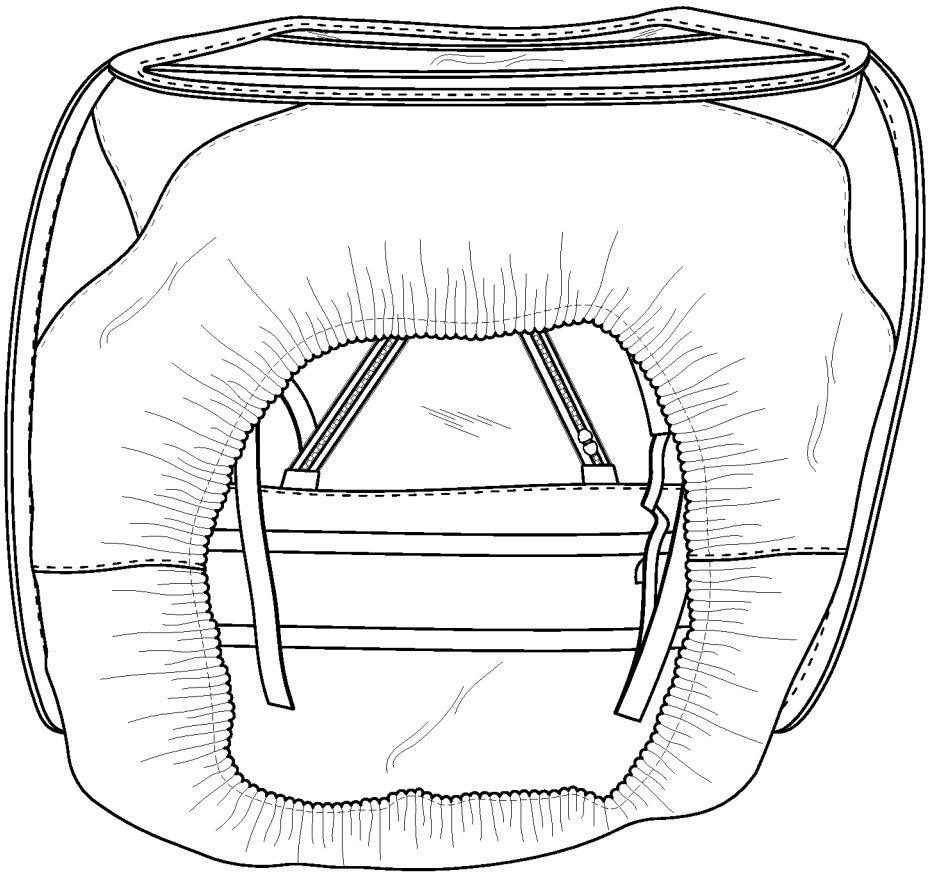
FIG. 9 is a photograph depicting a bottom view of the personal pop-up pod.

As best illustrated in FIGS. 2 and 8, the bottom of the personal pop-up pod 100 includes an opening 114. The opening 114 can include an elastic band 116 about the perimeter of the opening 114. The opening 114 allows a user to slide the personal pop-up pod 110 over the user's head and downward until the user is situated in the personal pop-up pod 100. The elastic band 116 can fit snuggly about the user's legs to further protect portions of the user's body from the elements. It will be understood that the user can remove the personal pop-up pod in a similar fashion by moving the personal pop-up pod upwardly over the user's head until the personal pop-up pod is removed from the user.

Figure 3:
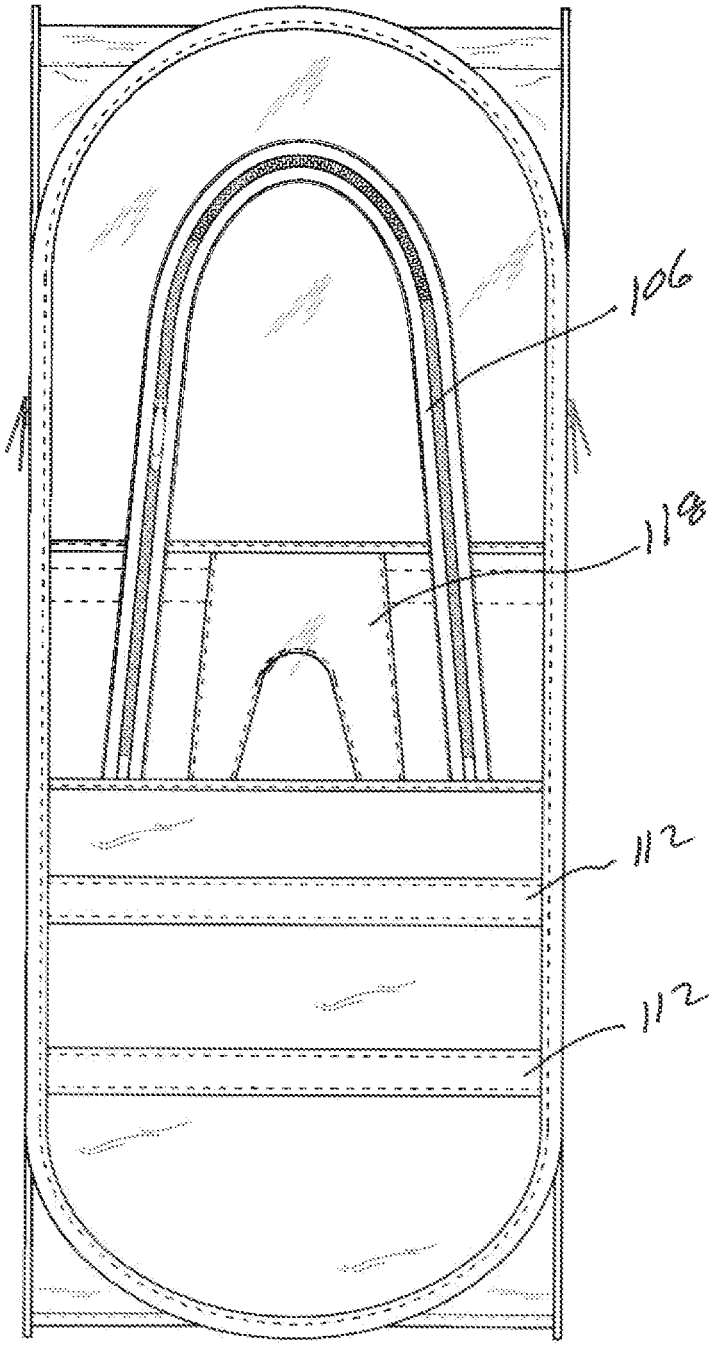
FIG. 3 schematically illustrates a front view of the personal pop-up pod of FIG. 1.
Figure 4:
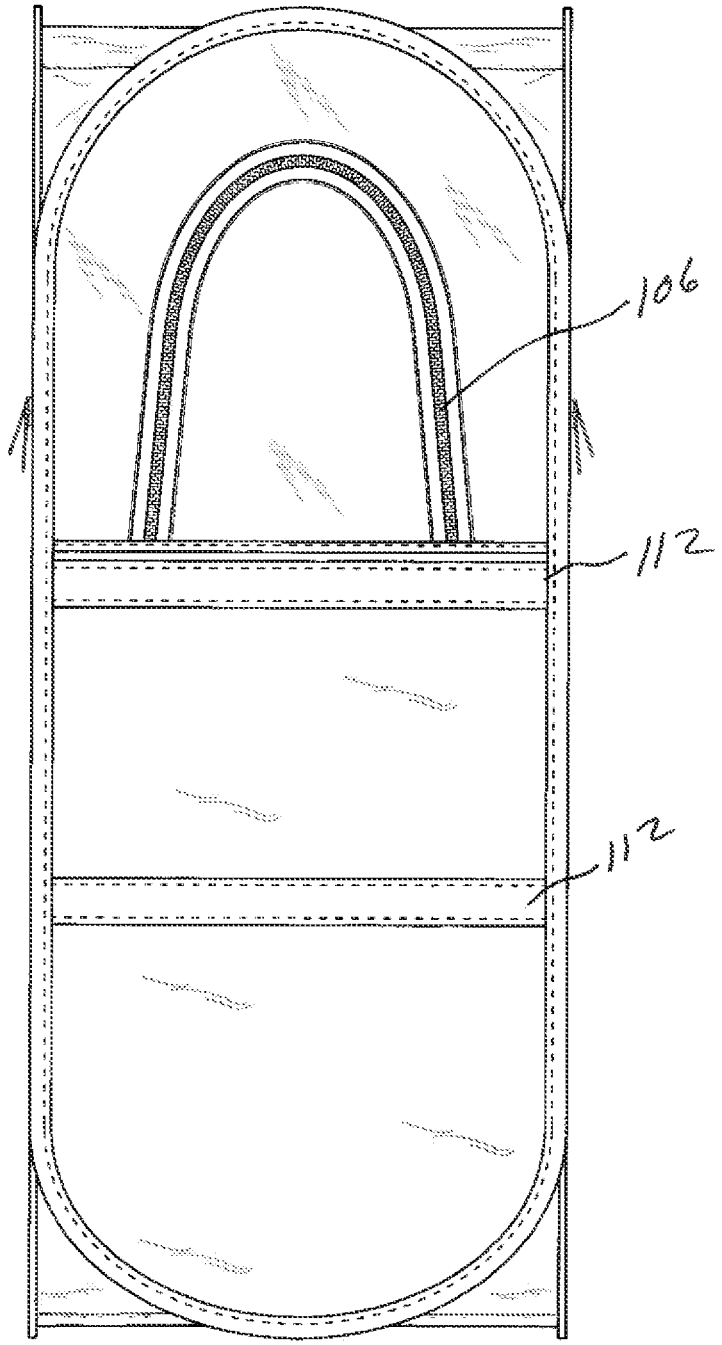
FIG. 4 schematically illustrates a rear view of the personal pop-up pod of FIG. 1.
Figure 5:
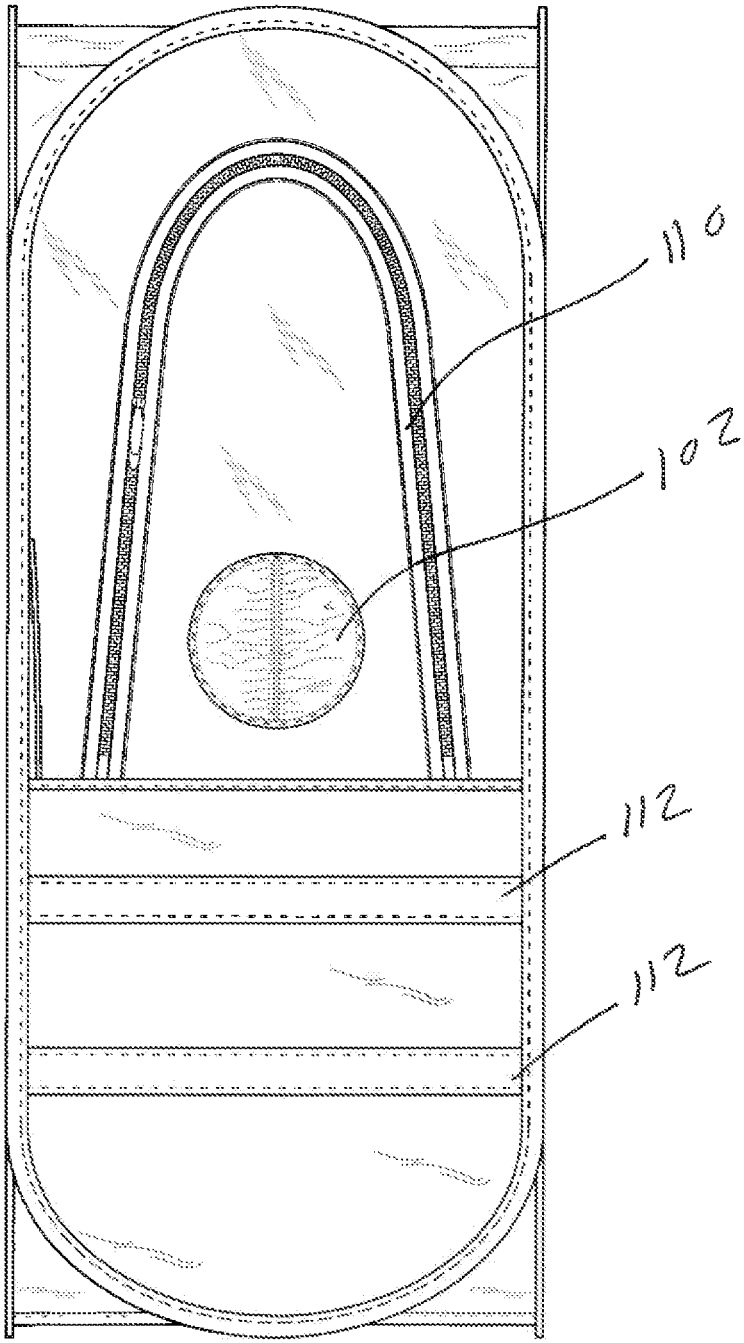
FIG. 5 schematically illustrates a left side view of the personal pop-up pod of FIG. 1.
Figure 6:
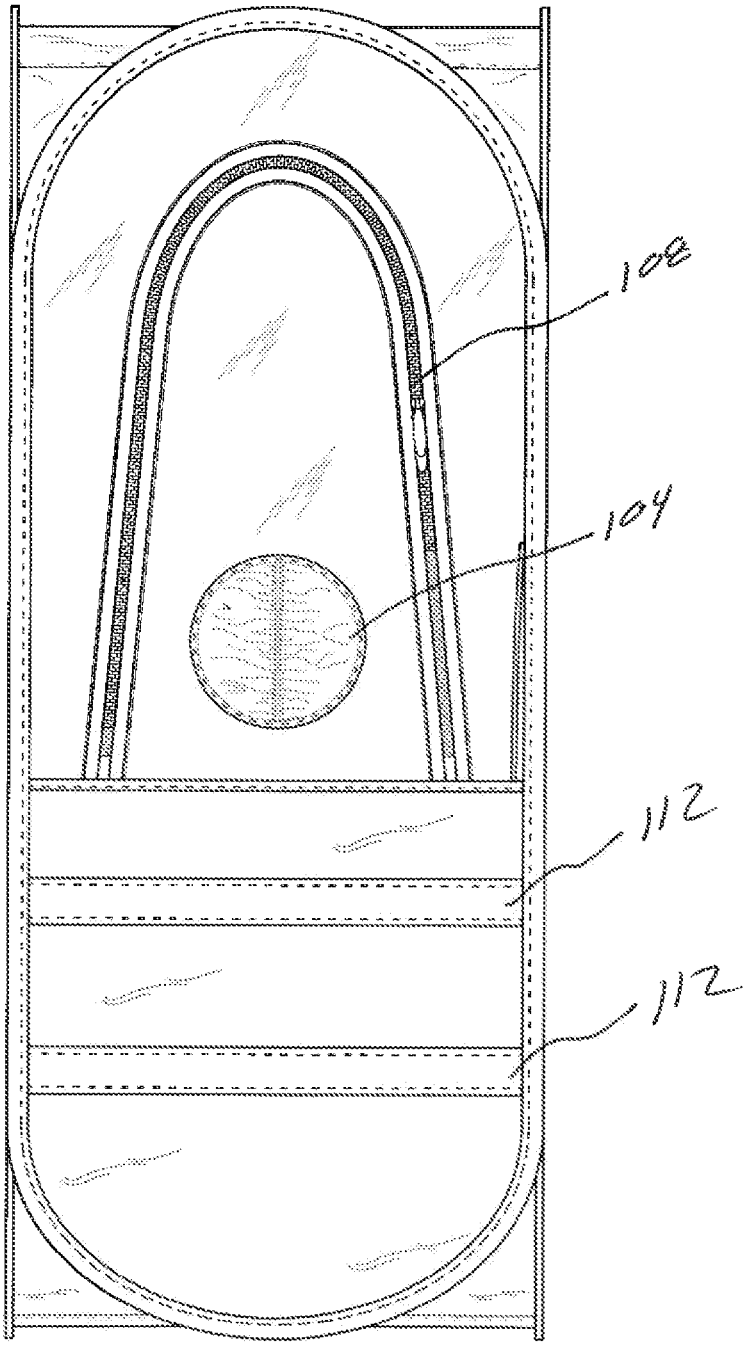
FIG. 6 schematically illustrates a right side view of the personal pop-up pod of FIG. 1.
Figure 7:
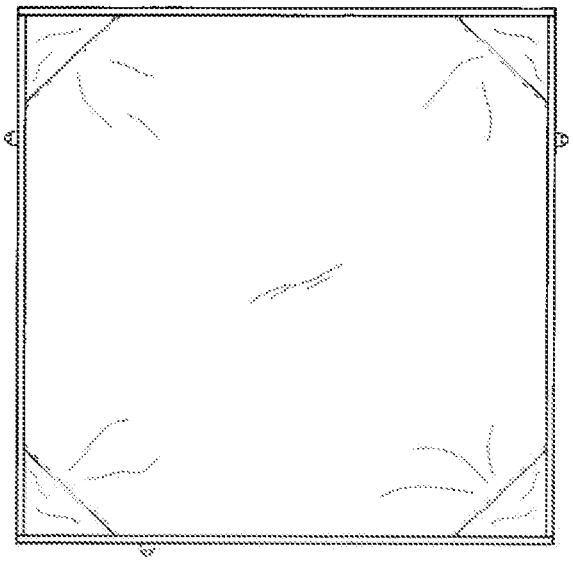
FIG. 7 schematically illustrates a top view of the personal pop-up pod of FIG. 1.

As best illustrated in FIG. 3, the personal pop-up pod 100 includes a harness 118. The harness 118 is secured to the inside surface of the rear side of the personal pop-up pod 100. When a user slides the personal pop-up pod 110 over the user's head and downward, the user can place an arm through each side of the harness 118 and position the harness 118 on the user's shoulder in a manner such that the personal pop-up pod 100 is fully supported by the engagement of the harness 118 and the user's shoulders. The harness 118 can include pull tabs (not shown) that can be pulled to take up any slack in the harness 118 and snuggly secure the harness 118 to the user's shoulders.

Once the harness 118 is snuggly secured to the user's shoulders, it will be understood that the personal pop-up pod 100 will generally move with the user, including moving in the same direction and distance as the user's forward and backward motion, side to side motion, twisting or rotating motion, and up and down motion. When the user is engaged with the harness 118 and the personal pop-up pod 100 is "carried" by the user, it will be understood that the rear side of the personal pop-up pod 100 will generally be in contact with or very close to the user's back and there will be gaps or spaces between the user's body and the front side, left side, and right side of the personal pop-up pod 100.

While the attachment mechanism of the personal pop-up pod is illustrated and described as a harness, it will be understood that other attachment mechanisms can be used. For example, two independent straps can be used in place of a harness.

Figure 10:
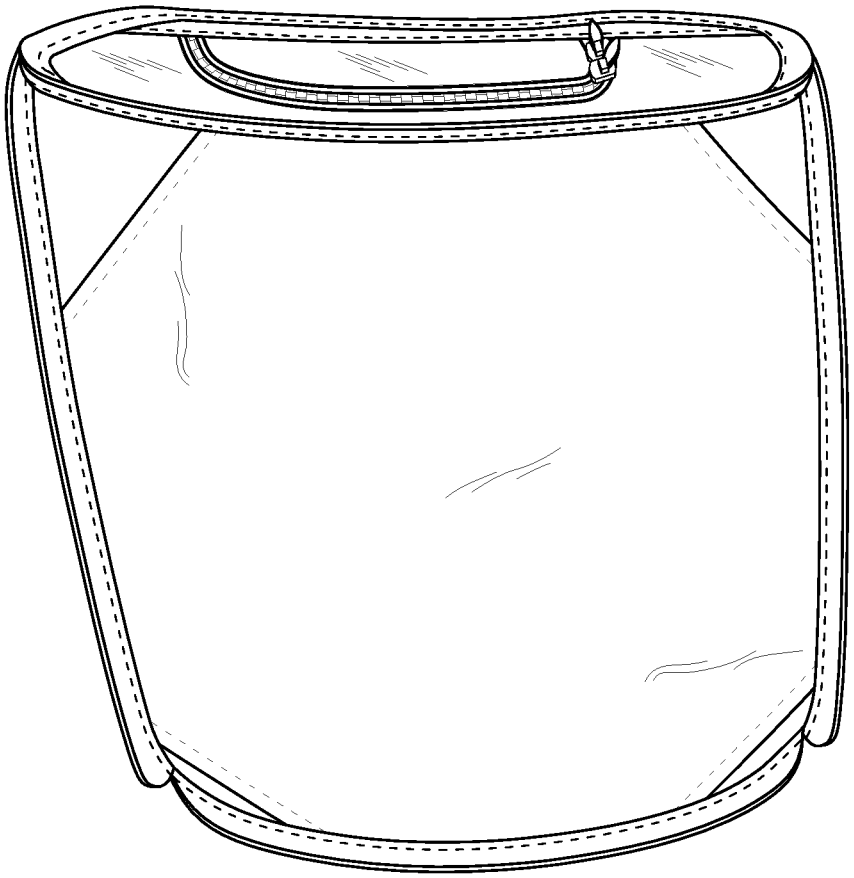
FIG. 10 is a photograph depicting a top view of the personal pop-up pod.

FIG. 10 is a photograph of a personal pop-up pod with an opaque top, where the material is a bright yellow (i.e., safety yellow), which provides additional safety for the user of the pod. Similar to the reflective tape, such a color can better alert those proximate to the user of the user's presence. In addition to safety yellow, other colors such as orange and red can be used as safety colors.

Figure 11:
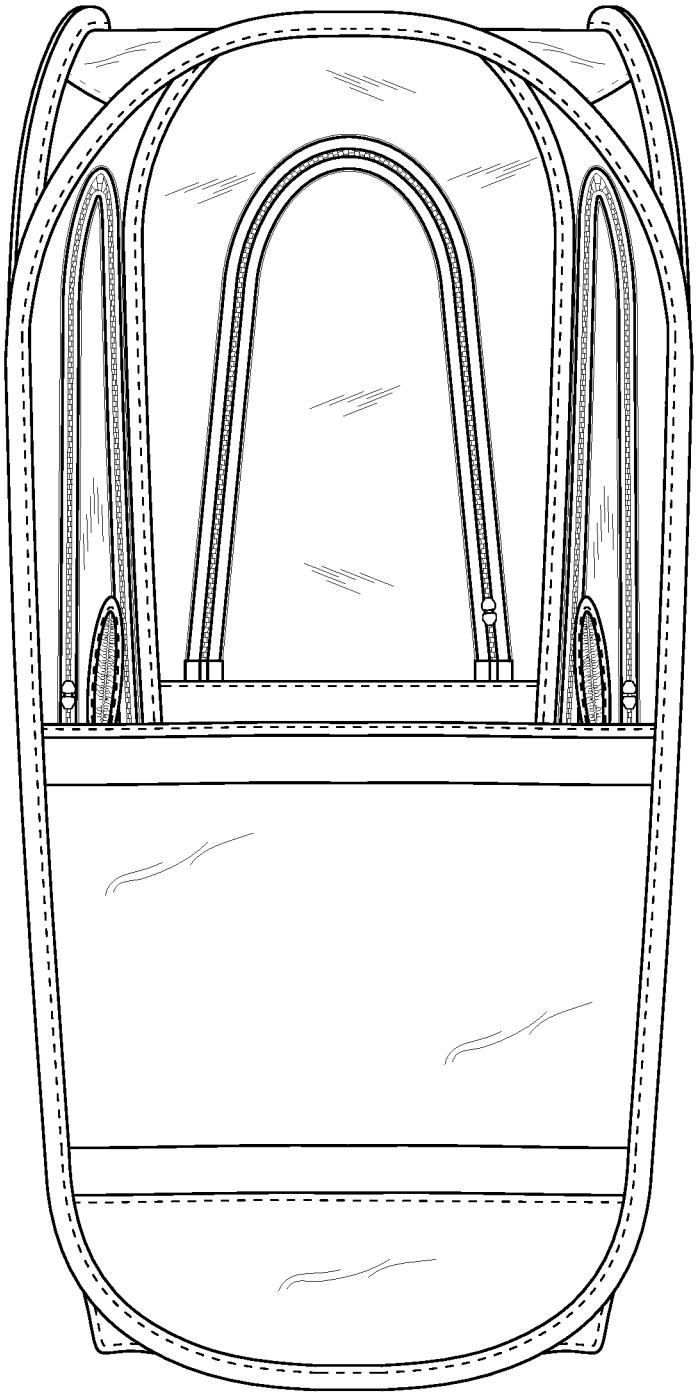
FIG. 11 is a photograph depicting a rear view of the personal pop-up pod.
Figure 12:
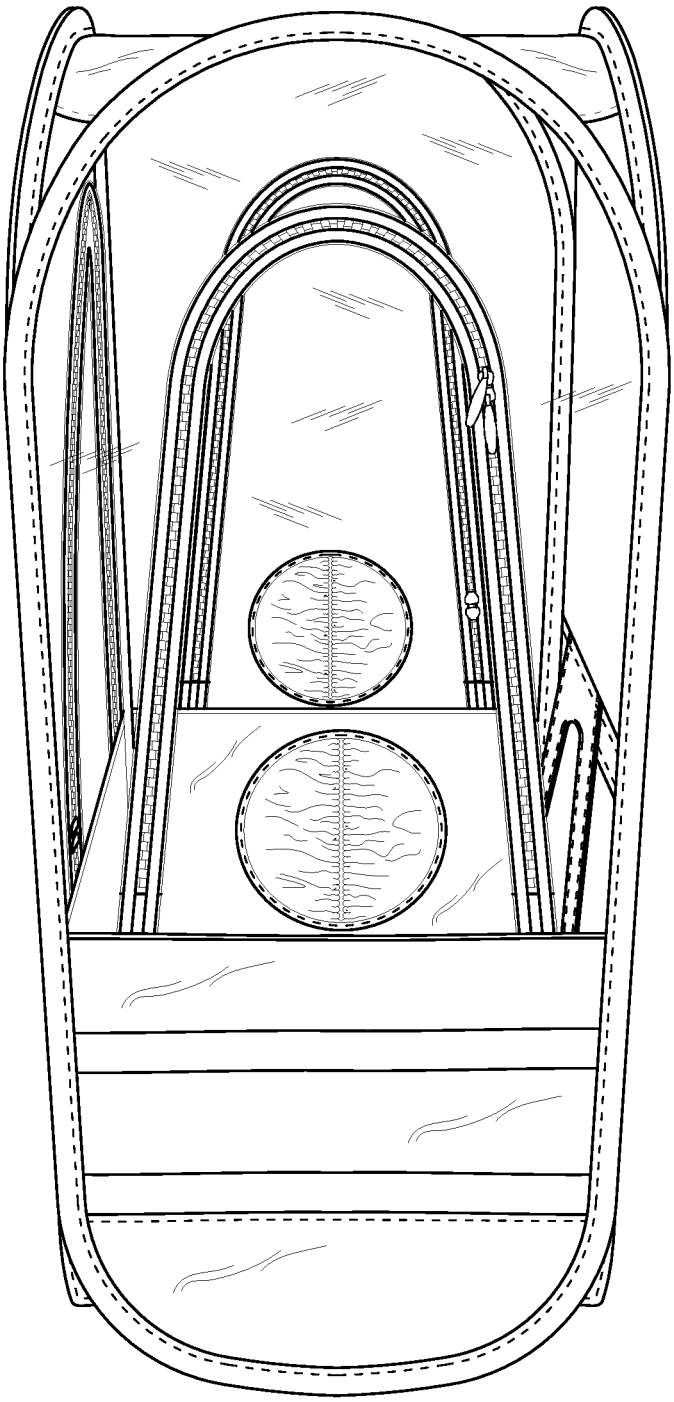
FIG. 12 is a photograph depicting a side view of the personal pop-up pod.
Figure 13:
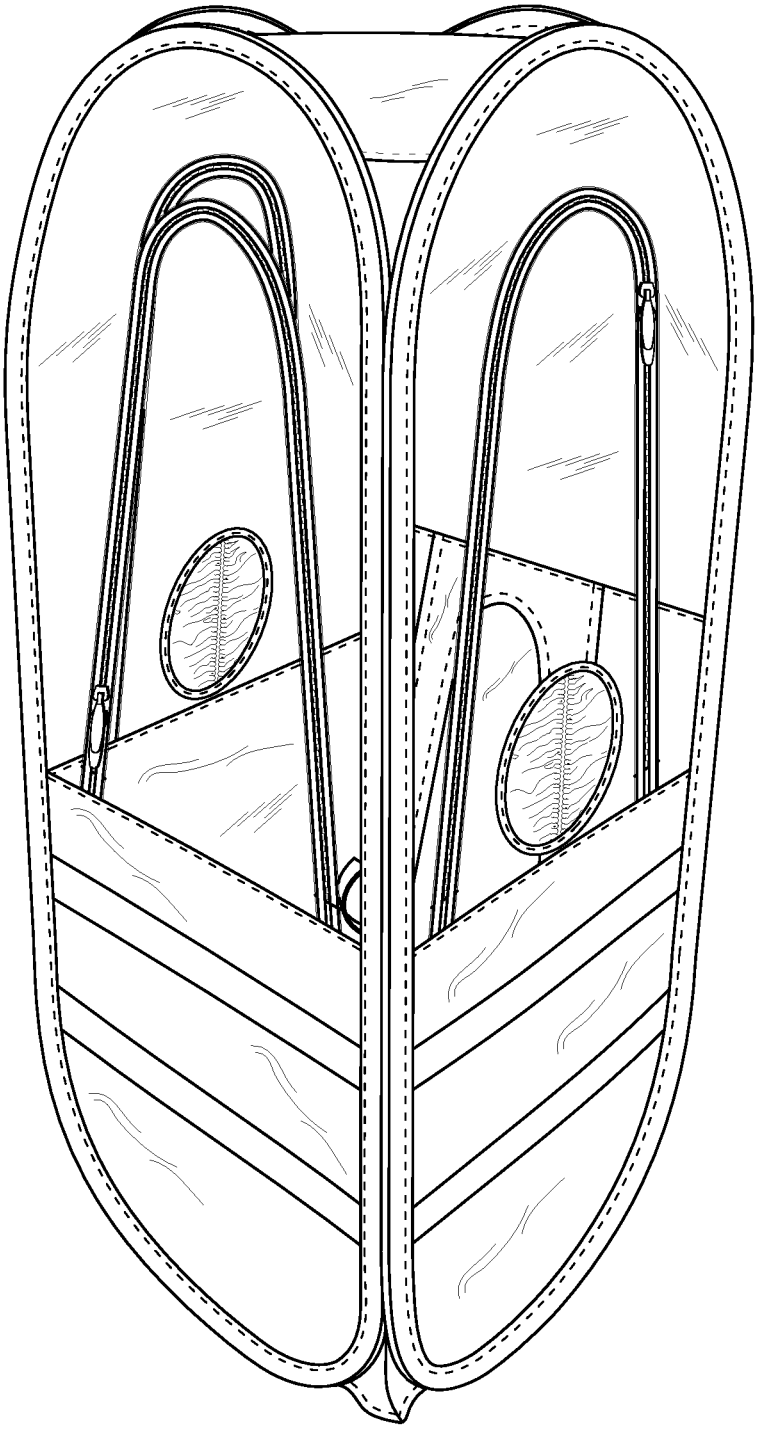
FIG. 13 is a photograph depicting a perspective view of the personal pop-up pod.
Figure 14:
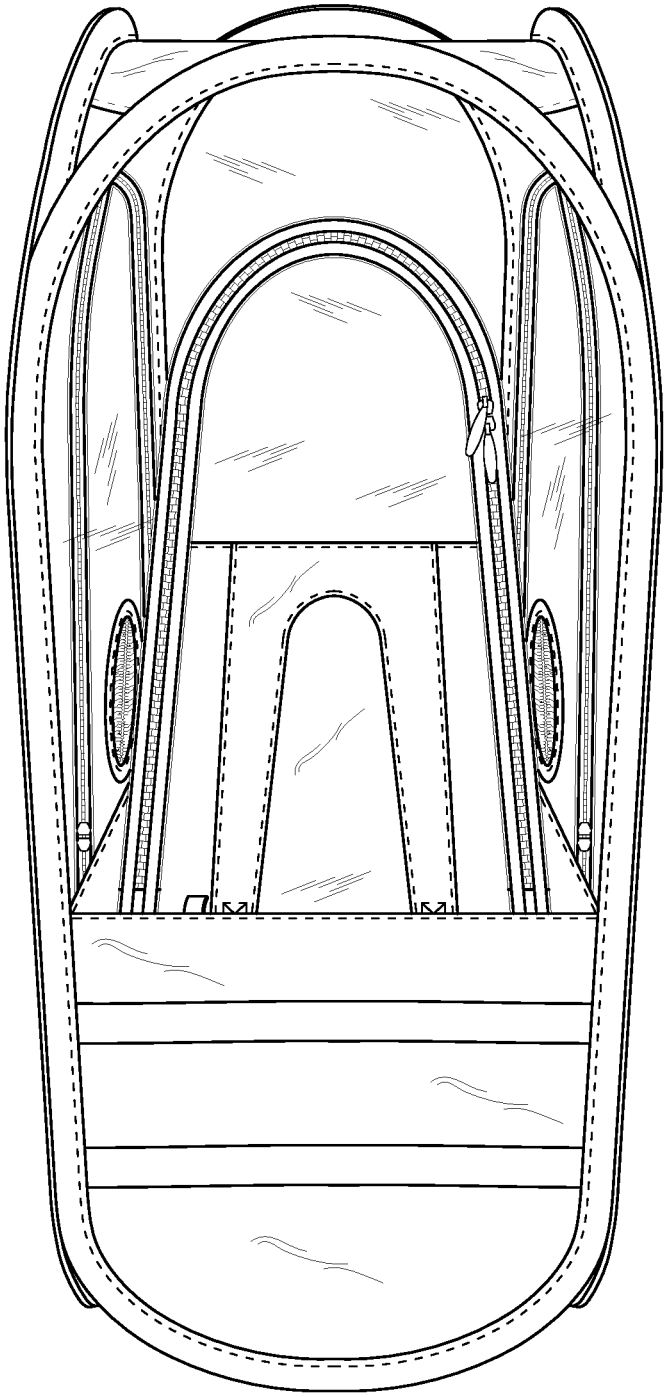
FIG. 14 is a photograph depicting a front view of the personal pop-up pod.
Figure 15:
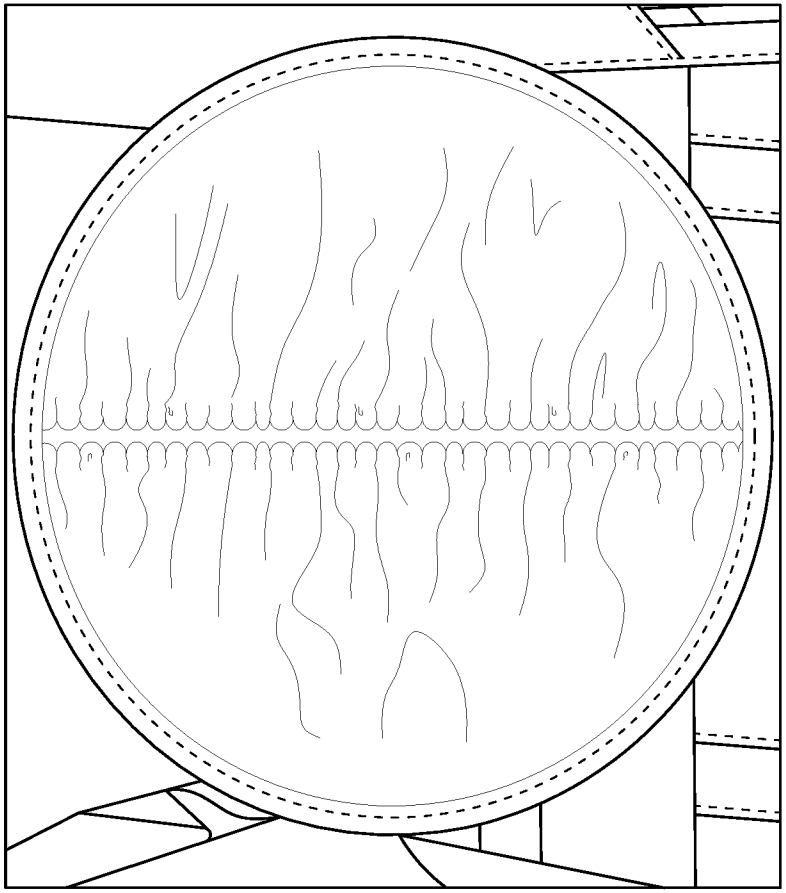
FIG. 15 is a photograph depicting an arm hole of the personal pop-up pod.

FIG. 11 is a photograph of a personal pop-up pod taken from the rear perspective. The photograph shows the top half of the personal pop-up pod with clear panels so that the user can have a 360 degree view of his or her surroundings. The bottom half of the personal pop-up pod includes opaque panels, again in a safety yellow, and a reflective tape. FIG. 12 is a photograph of the personal pop-up pod taken from a side perspective. The photograph show the arm holes in the left and right sides. The arm holes include slits that allow for the user to place his or her arms through the slits to access the surrounding environment with his or her arms. FIG. 13 is a photograph of the personal pop-up pod taken from a front perspective view. The photograph shows the features previously discussed. FIG. 14 is a photograph taken from a front perspective. The photograph shows the harness that a user utilizes to secure the personal pop-up pod to the user's body. FIG. 15 is a photograph of an arm hole. As is shown, the slit of the armhole can include two edges that have elastic bands running along the edges. As will be understood, when a user passes his or her arm through the slit, the elastic bands will snuggly conform to the user's arm so that the elements, including rain, snow, and wind will be blocked from entering the personal pop-up pod through the arm holes.

Figure 16:
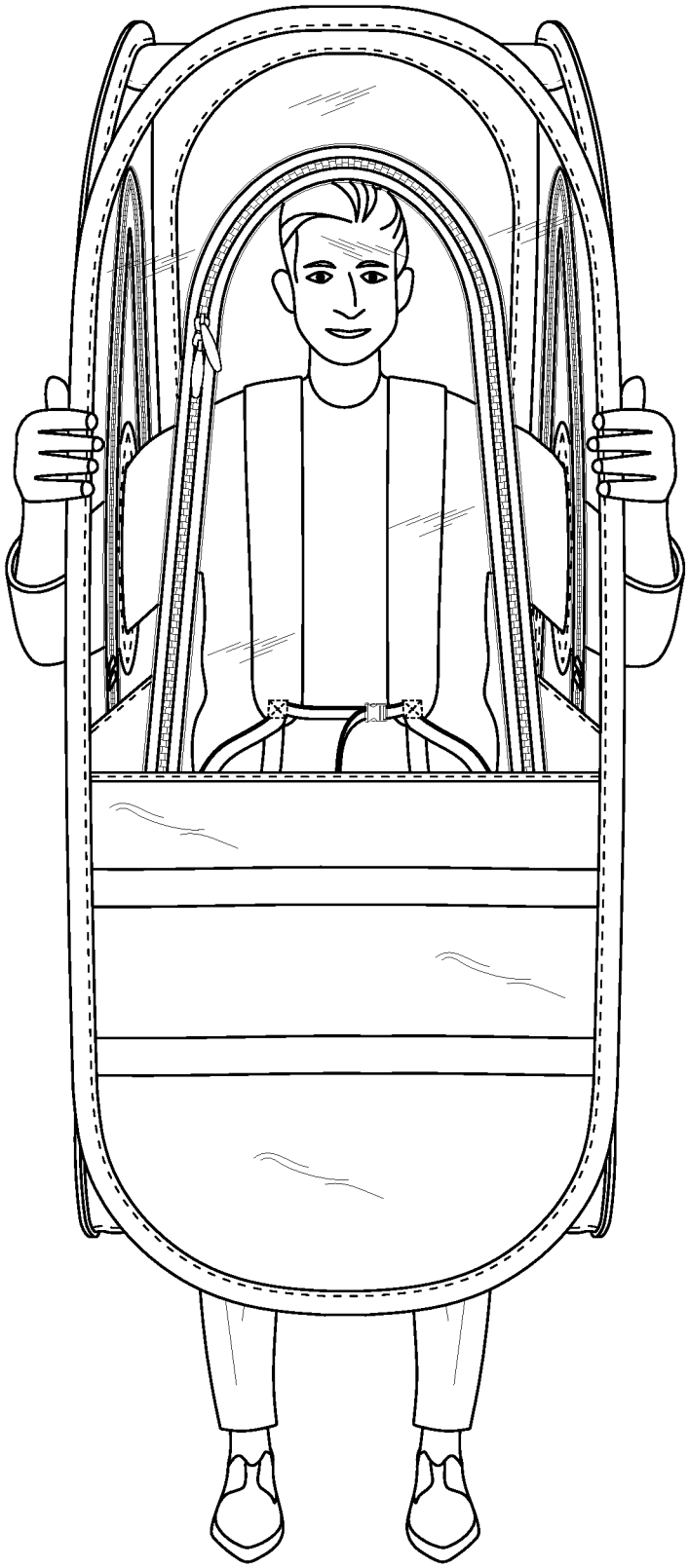
FIG. 16 is a photograph depicting a front view of the personal pop-up pod as carried by a user.
Figure 17:
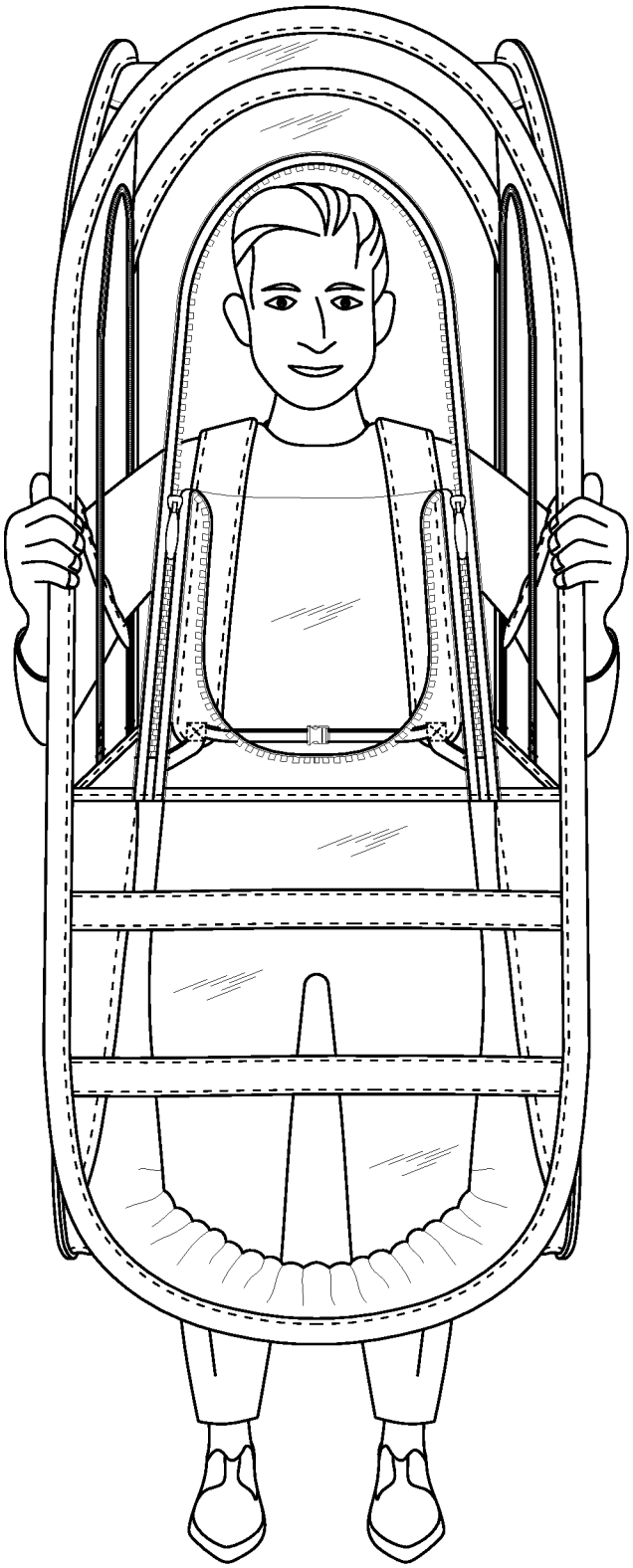
FIG. 17 is a photograph depicting a front view of another personal pop-up pod as carried by a user.
Figure 18:
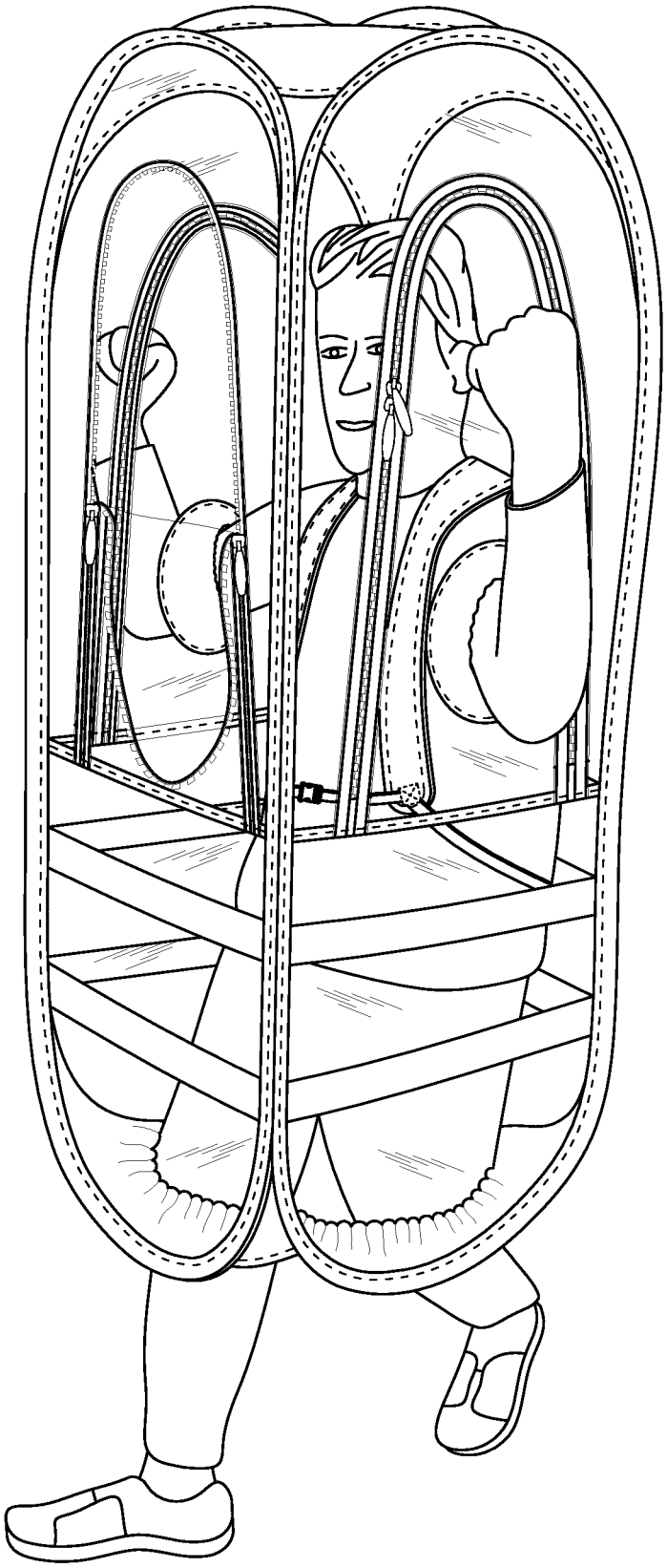
FIG. 18 is a photograph depicting a perspective view of the personal pop-up pod as carried by a user.
Figure 19:
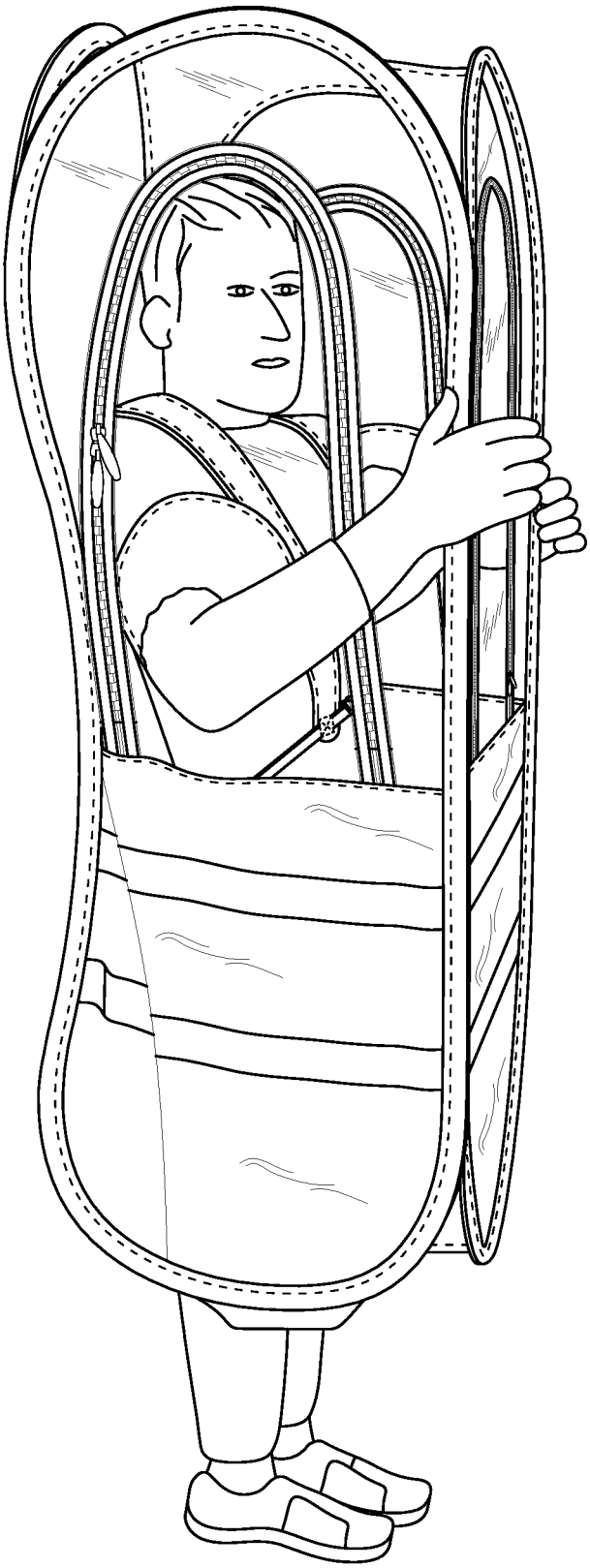
FIG. 19 is a photograph depicting a side view of the personal pop-up pod as carried by a user.
Figure 20:
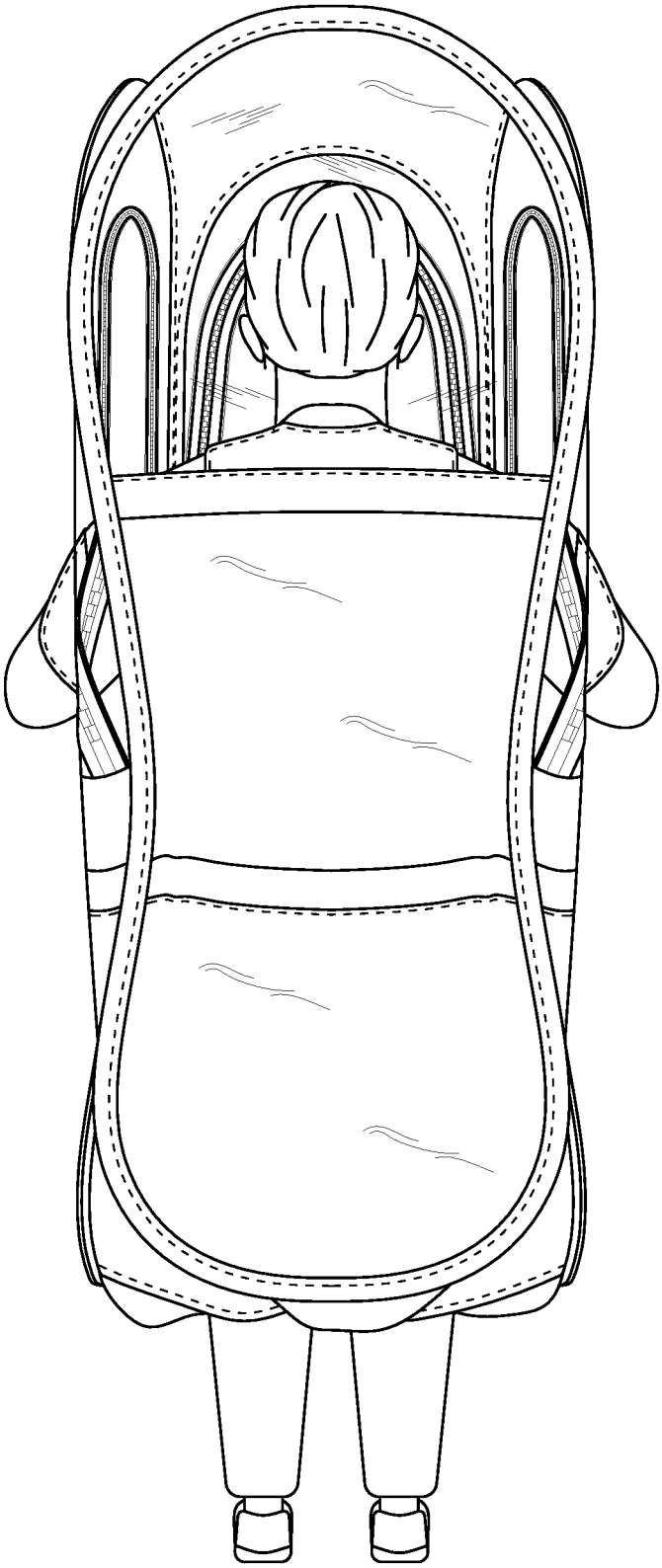
FIG. 20 is a photograph depicting a rear view of the personal pop-up pod as carried by a user.
Figure 21:
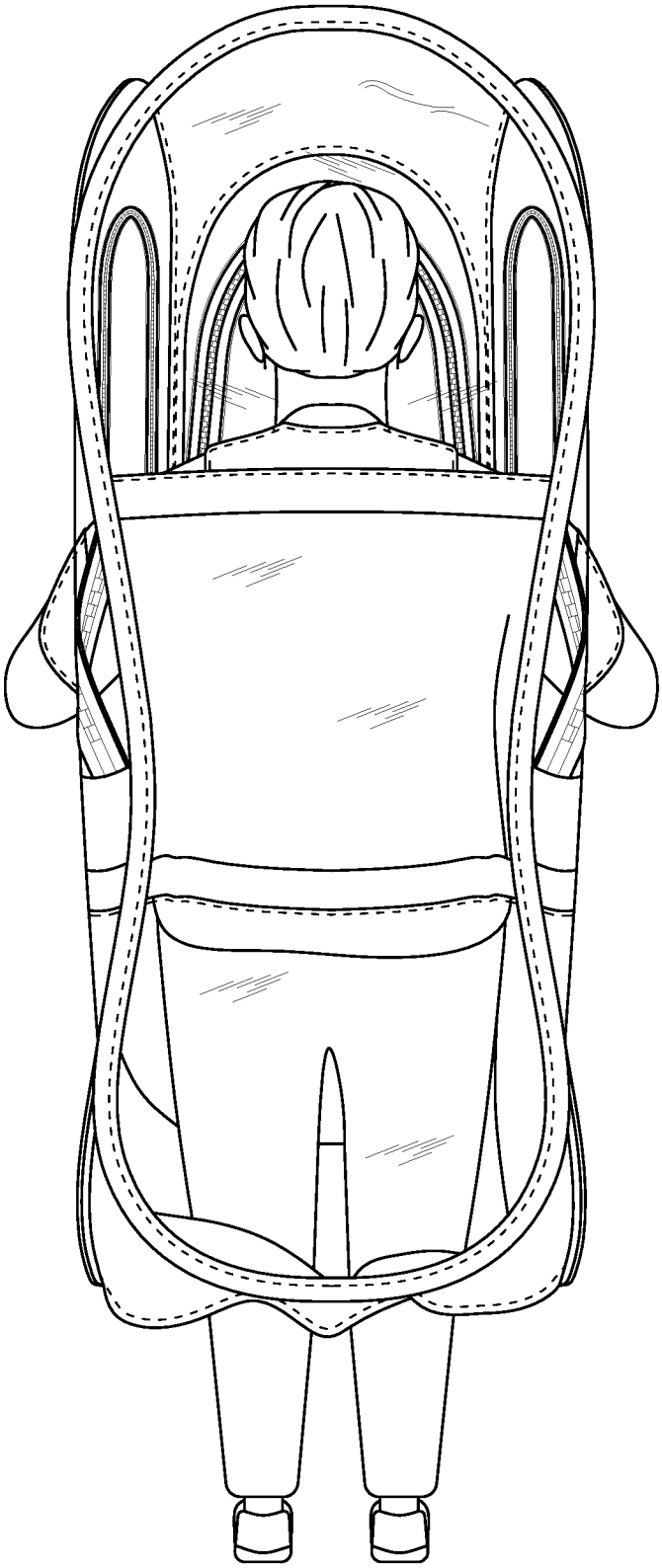
FIG. 21 is a photograph depicting a rear view of another personal pop-up pod as carried by a user.

FIGS. 16-21 are photographs of a user carrying a personal pop-up pod. FIG. 16 is a photograph taken from a front perspective showing a user carrying a personal pop-up pod with clear panels on the top half of the personal pop-up pod and opaque safety yellow panels with reflective tape on the bottom half of the personal pop-up pod. The harness can be seen across the user's shoulders, and the user has his arms extending through arm holds on either side of the personal pop-up pod. As illustrated in FIG. 16, in one embodiment, the height of the personal pop-up pod is about 54 inches and the width is about 22 inches. FIG. 17 is similar to FIG. 16, but the personal pop-up pod includes full clear panels. The full clear panels provides better visibility for the user and provides a more complete view of the user for those around the user. The reflective tape and safety yellow trim at the intersections of the side panels provides safety features for the user. FIG. 18 is a perspective view of the user carrying the personal pop-up pod shown in FIG. 17. In this view, the user is demonstrating the range of motion of his arms as they extend though the arm holes. It will be understood that the range of motion provided by the arm holes and the personal pop-up pod in general, allows the user to accomplish any number of physical tasks. For example, if the user is tasked with directing traffic with a flag or other instrument, the personal pop-up pod provides the range of motion required for such a task. Additionally, as shown in FIG. 18, the zipper in the front side is unzipped to provide a passage through the front panel of the personal pop-up pod. Such a passage in the front panel can be useful if the user is employed by a fast food restaurant and tasked with delivering meals to customers parked in automobiles who ordered via a drive through window. In such a situation, the user can protect the meals from inclement weather by keeping the meal within the personal pop-up pod. When the user approaches the automobile, the user can unzip the zipper in the front panel and hand the meal to the waiting customer. FIGS. 19-21 show additional views of a user carrying a personal pop-up pod.

As will be understood, the side panels, top panel, and bottom panel are made of material that resists the penetration of water and wind so that the personal pop-up pod protects the user from inclement elements such as snow, rain, sleet, and gusts. With regard to the harness, a top portion and bottom portion of the harness are attached at the rear panel of the personal pop-up pod. In such an arrangement, the user can slide his or her arms through each side of the harness (such is commonly done for a backpack) and tighten the straps to secure the personal pop-up pod to the user's shoulders and back. The user can then freely walk about with the personal pop-up pod secured to the user.

As previously noted, the personal pop-up pod can be used by workers that have to work in the elements. In one example, a crossing guard can use a personal pop-up pod to perform his or her duties in assisting children and other persons crossing busy streets. The zippers in the side panels can be unzipped to create windows, where the windows can allow the user of the personal pop-up pod to use a hand held stop sign that is common for crossing guards. In another example, a worker at a fast food restaurant can use a personal pop-up pod to move from vehicle to vehicle and take and deliver orders for customers in inclement weather. Again, the zippers can be used to open and close windows in the front and side panels to provide the user with the flexibility to hand out orders and take payment, while still remaining protected by from the elements.

Further disclosed herein are novel personal pop-up pods designed for a single user, which can provide the user with protection from the surrounding elements and provide the user with privacy. In summary, the personal pop-up pods disclosed herein are designed for various purposes. For example, a personal pop-up pod can be designed to accommodate a user that is seated in a generally crowded environment with other persons seated next to the user, such as for example in a sports stadium (i.e., a "stadium pod"). In such an example, a stadium pod can protect the user from the surrounding elements, such as rain, snow, wind, and cold, while allowing the user to view the event. In another example, a personal pop-up pod can be designed to accommodate a user that is seated in a generally crowded environment with other persons seated next to the user, such as for example an airplane, train, bus, subway, and the like (i.e., a "travel pod"). In such an example, a travel pod can provide the user with privacy in an otherwise crowded area. In another example, a personal pop-up pod can be designed to accommodate a user that needs to move from one location to another, such as a worker that needs to work outside in the elements (i.e., a "mobile pod").

Figure 22:
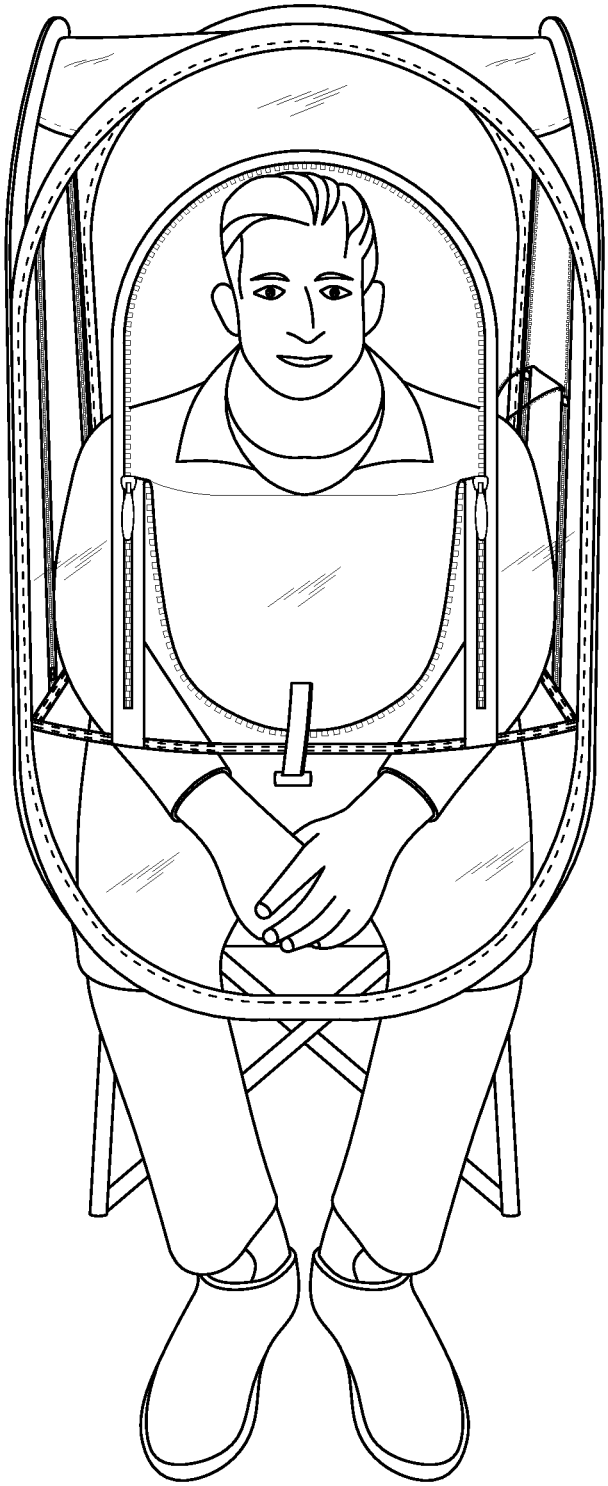
FIG. 22 schematically illustrates an exemplary front perspective view of a personal pop-up pod that accommodates one user.
Figure 23:
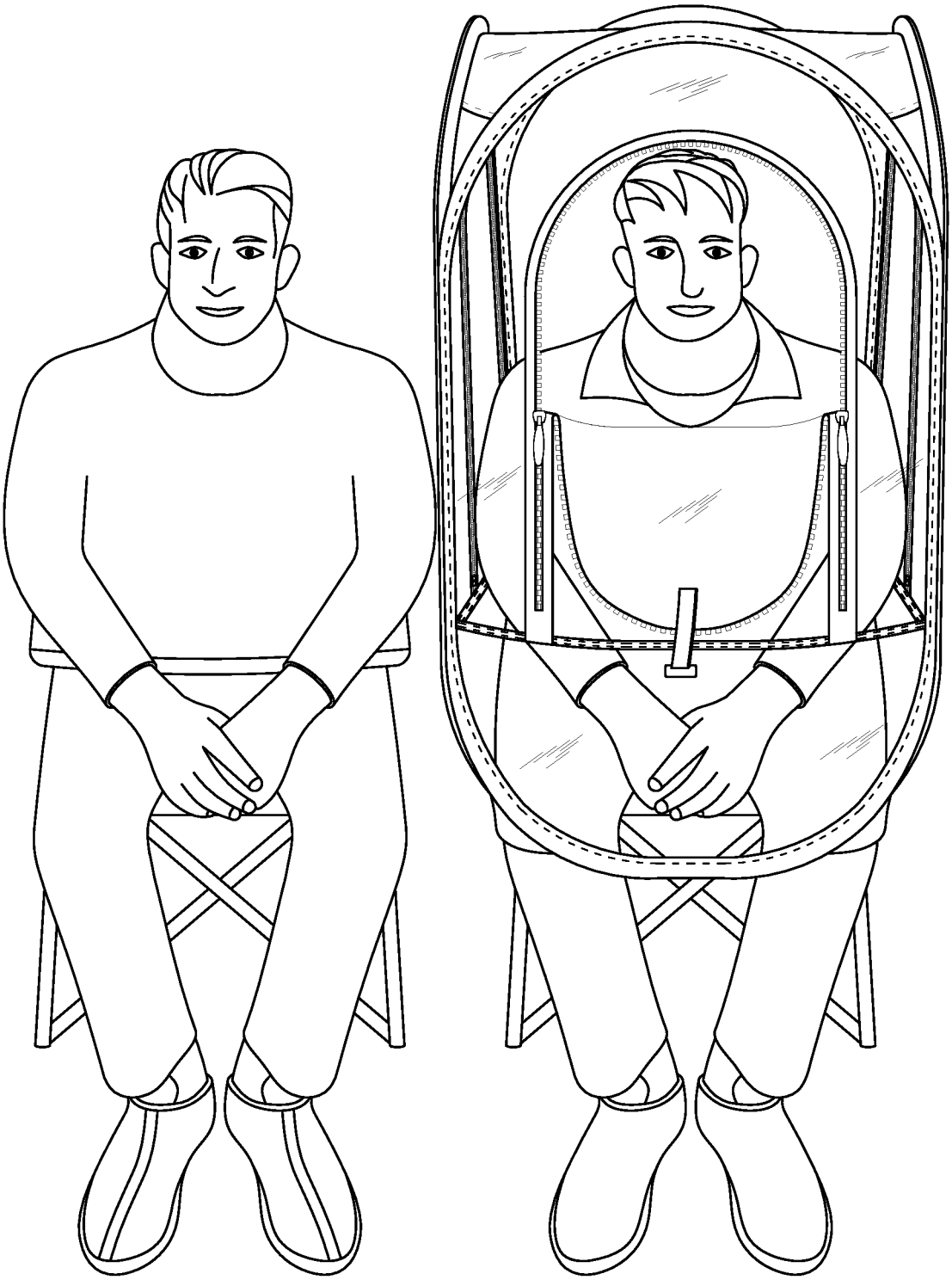
FIG. 23 schematically illustrates an exemplary front perspective view of a personal pop-up pod of FIG. 22, where the user is seated next to another person.
Figure 24:
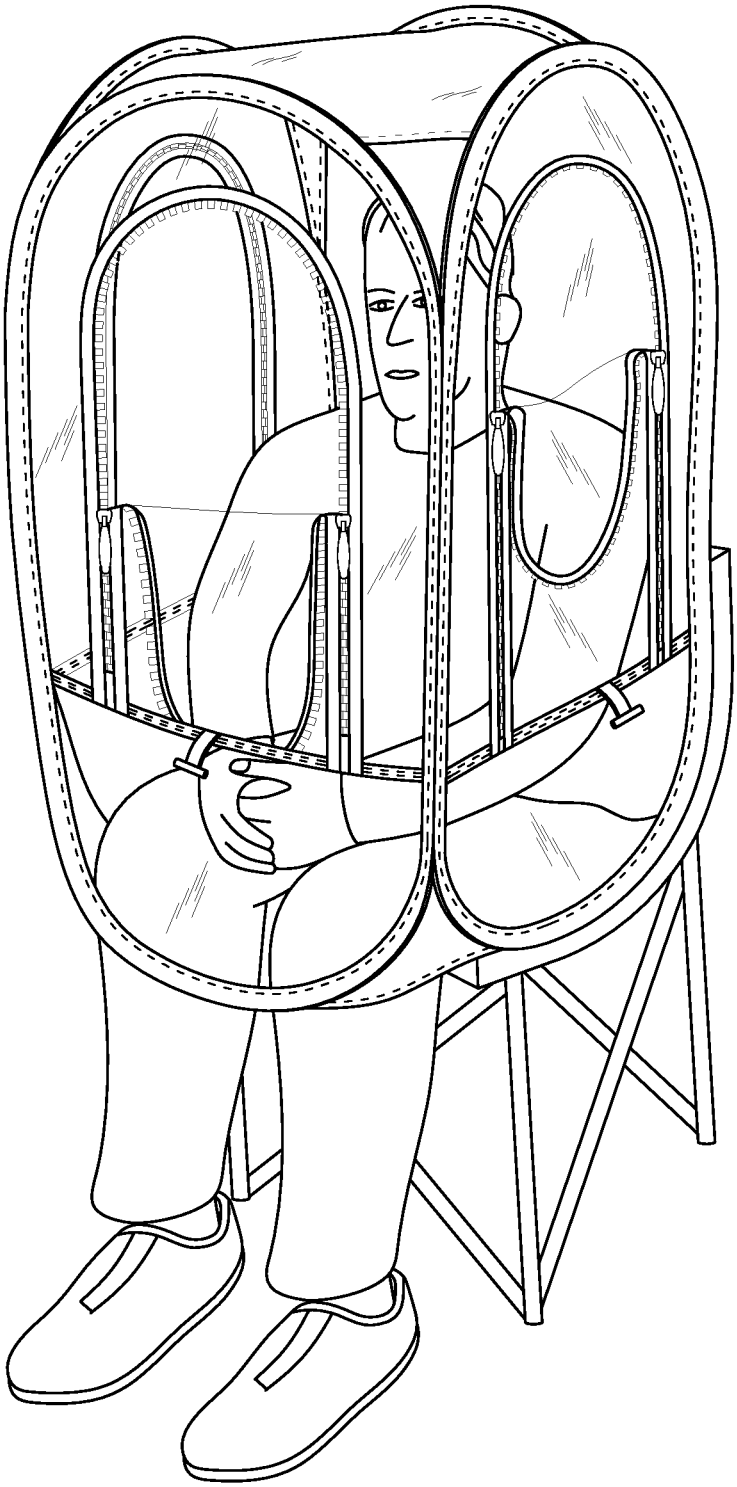
FIG. 24 schematically illustrates an exemplary perspective view of the personal pop-up pod of FIG. 22.

FIGS. 22-24 illustrate an embodiment of a stadium pod. The stadium pod includes four transparent side panels and a top panel, which can be either transparent or, as illustrated in the figures, opaque. The transparent side panels and the top panel are made of materials that resist the penetration of water, thus, protecting the user in rainy or snowy weather. Additionally, the side panels and top panel hold in body heat, which increases the temperature within the stadium pod as compared to the ambient temperature. The transparent side panels provide the user with 360 degree viewing so that the user can observe the surrounding activities, such as a sporting event. The side panels can include windows that can be opened and closed using a one or more fasteners, such as zippers, so that the user can communicate with persons seated next to the user or receive items, such as food and drink, through the windows. Additionally, a window can be opened to increase ventilation within the stadium pod if desired by the user. The bottom of the stadium pod can be generally open, or can include a flap of material that the user can sit on when seated in a stadium chair or on a stadium bleacher. As illustrated in FIG. 23, the stadium pod is designed so that it accommodates a user, but is not obstructive to those seated next to the user. Additionally, the transparent side panels allow for any person seated behind the user to see though the stadium pod.

Figure 25:
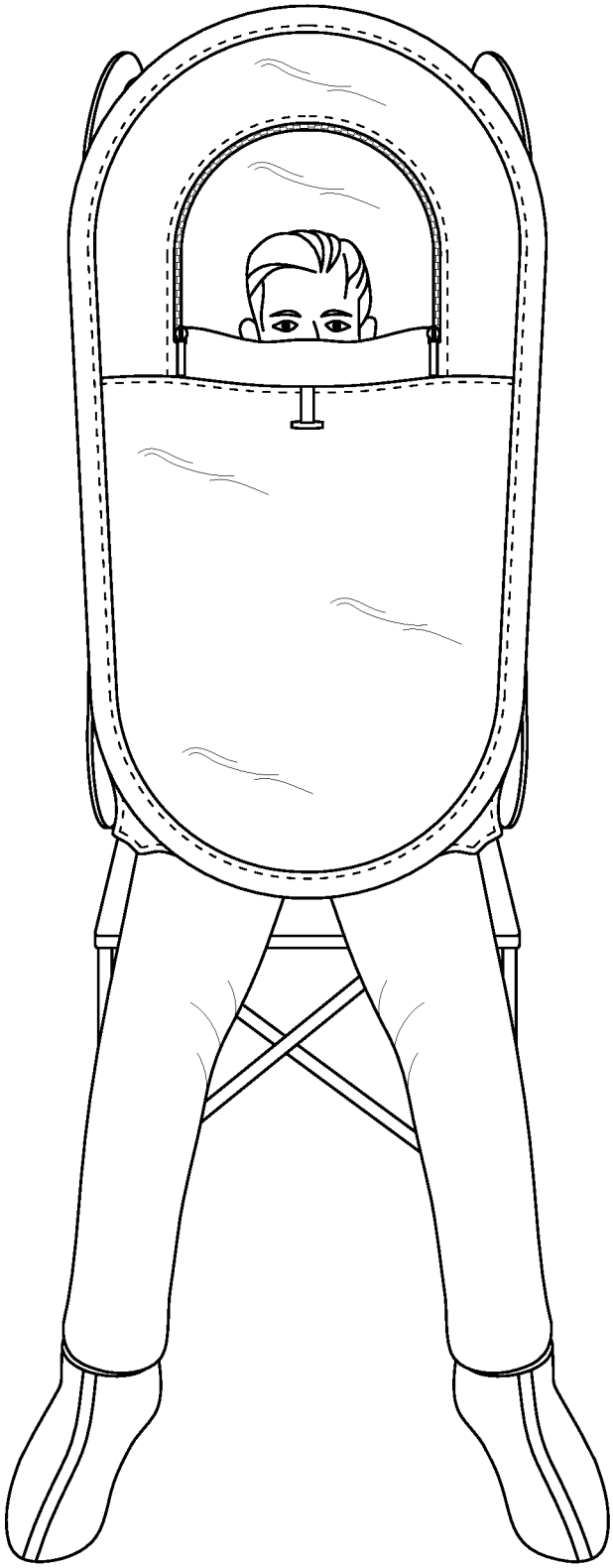
FIG. 25 schematically illustrates an exemplary front perspective view of another personal pop-up pod that accommodates one user.
Figure 26:
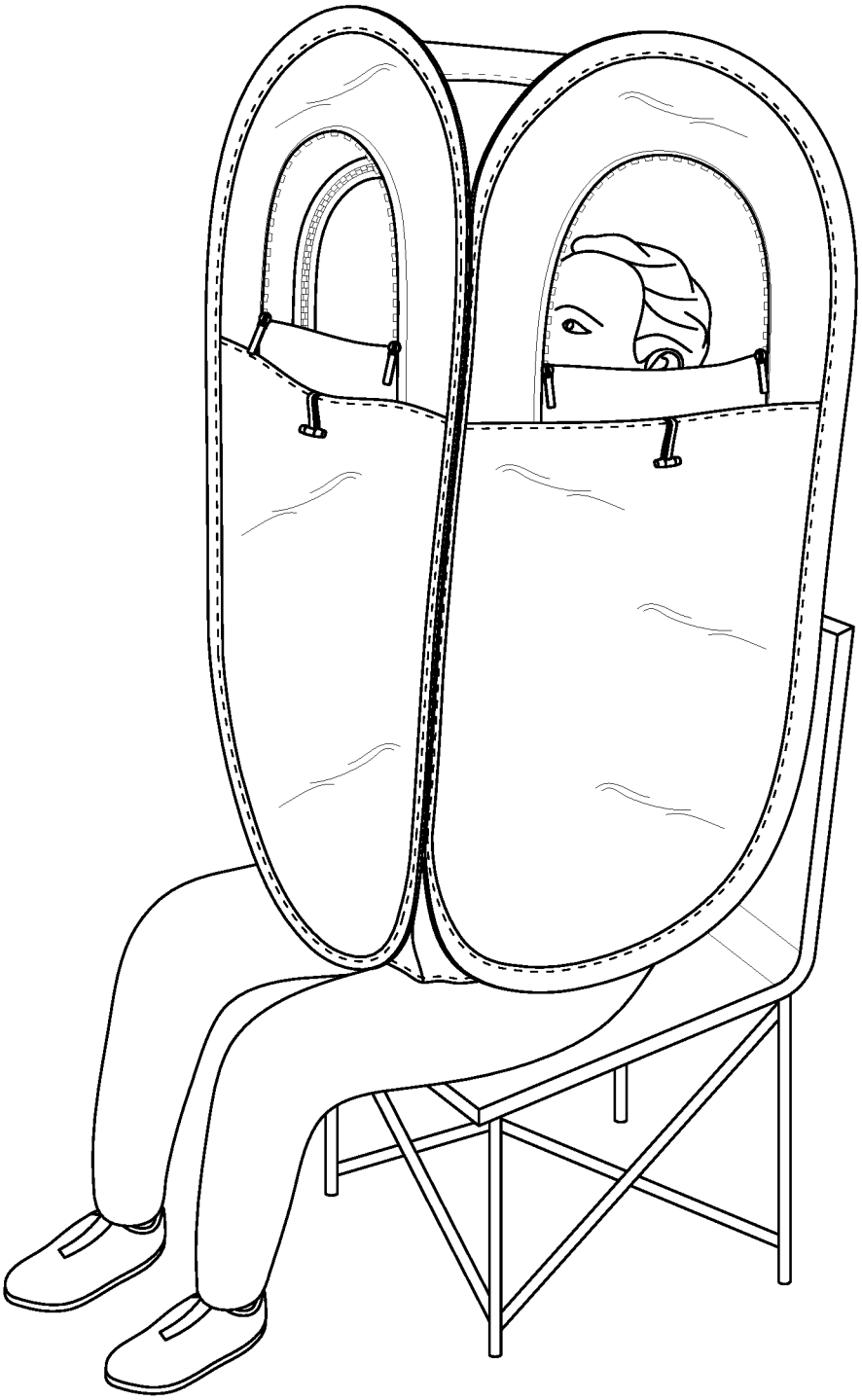
FIG. 26 schematically illustrates a perspective view of the personal pop-up pod of FIG. 25.

FIGS. 25-26 illustrate an embodiment of the travel pod. The travel pod includes four opaque side panels and an opaque top panel. Multiple of the side panels can include windows that are opened and closed using fasteners such as zippers. The opaque side panels and top panel can provide the user with privacy as the user travels via publicly available transportation such as airplanes, trains, buses, subways, and the like. Additionally, the side panels and top panel can provide the user with protection against germs and viruses that are commonly spread when person congregate in crowded and enclosed areas. The user can open and close the window are desired. The user can open a window to communicate with persons seated next to the user or to receive items, such as food and drink, through the windows. The bottom of the travel pod is generally open. The travel pod is designed so that it accommodates a user, but is not obstructive to those seated next to the user. The materials used for the side panels and top panels can be arranged to allow the pod to "breath." That is to say that the material allows air to pass through the material to ventilate the travel pod, but does not allow of germs and viruses to penetrate the material.

A mobile pod can be designed generally like the stadium pod; however, the mobile pod can include a support mechanism that is connected to the inside of the mobile pod and engage the user such that the mobile pod is supported by such engagement and remains position about the user as the user moves from one location to another location. The mobile pod includes four side panels and a top panel. The one or more side panels can be transparent. The side panels and top panel are made of material that resists the penetration of water so that the mobile pod protects the user from inclement elements such as snow, rain, and sleet. In one example, the support mechanism can be a pair of straps similar to that of a backpack. A top portion and bottom portion of each strap is attached at the back panel of the mobile pod. In such an arrangement, the user can slide his or her arms through the straps (such is commonly done for a backpack) and tighten the straps to secure the mobile pod to the user's shoulders and back. The user can then freely walk around with the mobile pod secured to the user.

In another example, the support mechanism can be a pair of straps. However, in this example, one end of each strap is attached to the front panel of the mobile pod and the opposite end of each strap can be secured to the back panel of the mobile pod. The straps can be secured in a manner where the user can place the straps on his or her shoulders so that the mobile pod is supported about the user. In another example, the support mechanism can include a waist strap attached to the pair of straps, which is secured about the user's waist. In such an arrangement, the user can then freely walk around with the mobile pod secured to the user.

As previously noted, the mobile pod can be used by workers that have to work in the elements. In one example, a crossing guard can use a mobile pod to perform his or her duties in assisting children and other persons crossing busy streets. The windows can allow the user of the mobile pod to use a hand held stop sign that is common for crossing guards. In another example, a worker at a fast food restaurant can use a mobile pod to move from vehicle to vehicle and take and deliver orders for customers in inclement weather. Again, the windows provide the user with the flexibility to hand out orders and take payment, while still remaining protected by from the elements.

The foregoing description of examples has been presented for purposes of illustration and description. It is not intended to be exhaustive or limiting to the forms described. Numerous modifications are possible in light of the above teachings. Some of those modifications have been discussed, and others will be understood by those skilled in the art. The examples were chosen and described in order to best illustrate principles of various examples as are suited to particular uses contemplated. The scope is, of course, not limited to the examples set forth herein, but can be employed in any number of applications and equivalent devices by those of ordinary skill in the art.

I claim:

1. A personal pop-up pod for a single user, the personal pop-up pod comprising:

an enclosure comprising a front panel, a rear panel, a left side panel, a right side panel, and a top panel coupled together to form an interior space;

a first arm aperture positioned in the left side panel to accommodate one of a user's arms;

a second arm aperture positioned in the right side panel to accommodate one of a user's arms;

a left window positioned in the left side panel and defined by a flap of material connected to a remainder of the left side panel by a zipper closure; and a right window positioned in the right side panel and defined by a flap of material connected to a remainder of the right side panel by a zipper closure, wherein the zipper closures may be used to selectively open the left and right windows for communication between the interior space and an exterior environment, wherein the first arm aperture is positioned in the flap of material defining the left window, and the second arm aperture is positioned in the flap of material defining the right window; and wherein the personal pop-up pod further comprises:

a front window positioned in the front panel, wherein a zipper is positioned along an edge of the front window to selectively open and close the front window.

2. The personal pop-up pod of claim 1, wherein each of the zipper closures follows a downwardly-oriented U-shaped path that surrounds the corresponding first or second arm aperture.

3. The personal pop-up pod of claim 2, wherein a height of the flaps of material and the zipper closures extends over at least half of a total height of the corresponding left side panel and right side panel.

4. The personal pop-up pod of claim 1, wherein the enclosure further includes a bottom panel coupled to the front panel, the rear panel, the left side panel, and the right side panel.

5. The personal pop-up pod of claim 4, wherein the front panel, the rear panel, the left side panel, the right side panel, the top panel, and the bottom panel are constructed of material resistant to the penetration of water.

6. The personal pop-up pod of claim 4, wherein the bottom panel includes an opening to accommodate a lower body portion of a user, and the opening includes a generally circular edge and an elastic member secured along the generally circular edge, wherein when a user uses the personal pop-up pod, the generally circular edge of the bottom panel conforms to a lower body portion of a user.

7. The personal pop-up pod of claim 1, further comprising:

a harness secured to an inside surface of the enclosure.

8. The personal pop-up pod of claim 7, wherein the harness comprises:

a left shoulder strap;

a right shoulder strap;

a left strip, wherein a top portion of the left strip is secured to a bottom portion of left shoulder strap; and a right strip, wherein a top portion of the right strip is secured to a bottom portion of the right shoulder strap.

9. The personal pop-up pod of claim 8, wherein the harness is secured to the inside surface at the rear panel by: securing a top portion of the left shoulder strap to the inside surface of the rear panel; securing a top portion of the right shoulder strap to the inside surface of the rear panel; securing a bottom portion of the left strip to the inside surface of the rear panel; and securing a bottom portion of the right strip to the inside surface of the rear panel.

10. The personal pop-up pod of claim 9, further comprising:

a left pull tab arranged to adjust the length of the left strip; and a right pull tab arranged to adjust the length of the right strip.

11. The personal pop-up pod of claim 1, further comprising:

at least one reflective strip secured to an outside surface of the enclosure.

12. The personal pop-up pod of claim 11, wherein the at least one reflective strip is secured along a lower half of each of the front panel, the rear panel, the left side panel, and the right side panel, and the personal pop-up pod further comprises:

an opaque portion along at least the top panel, the opaque portion being colored with a safety color such as yellow, orange, or red.

13. The personal pop-up pod of claim 1, wherein the front panel, the rear panel, the left side panel, the right side panel, and the top panel collectively define a rectangular cuboid shape for the enclosure, with each of the panels connected to adjacent panels by discrete edge or corner junctions that help define the rectangular cuboid shape of the enclosure.

14. The personal pop-up pod of claim 1, wherein:

the first arm aperture comprises:

a first section of material including a first edge and a first elastic member secured along the first edge;

a second section of material including a second edge and a second elastic member secured along the second edge; and a first slit formed between the first edge and the second edge; and the second arm aperture comprises:

a third section of material including a third edge and a third elastic member secured along the third edge;

a fourth section of material including a fourth edge and a fourth elastic member secured along the fourth edge; and a second slit formed between the third edge and the fourth edge.

15. The personal pop-up pod of claim 14, wherein when a user places an arm through the first slit, the first elastic member and the second elastic member conform to a user's arm; and when a user places an arm through the second slit, the third elastic member and the fourth elastic member conform to a user's arm.

16. A method of protecting a user from local environmental conditions, comprising:

lifting a personal pop-up pod over a head of the user, the personal pop-up pod including an enclosure comprising a front panel, a rear panel, a left side panel, a right side panel, and a top panel coupled together to form an interior space; a left window positioned in the left side panel and defined by a flap of material connected to a remainder of the left side panel by a zipper closure; a right window positioned in the right side panel and defined by a flap of material connected to a remainder of the right side panel by a zipper closure; a first arm aperture positioned in the left side panel at the flap of material; and a second arm aperture positioned in the right side panel at the flap of material;

lowering the personal pop-up pod onto the user such that the user is substantially located within the interior space;

inserting the user's arms into and through the first and second arm apertures to allow the user to work with the user's arms outside the personal pop-up pod; and selectively opening the left and right windows by using the zipper closures.

17. The method of claim 16, wherein the first arm aperture includes a first section of material including a first elastic member secured along a first edge, a second section of material including a second elastic member secured along a second edge, and a first slit formed between the first edge and the second edge; the second arm aperture includes a third section of material including a third elastic member secured along a third edge, a fourth section of material including a fourth elastic member secured along a fourth edge, and a second slit formed between the third edge and the fourth edge; and the step of inserting the user's arms further comprises:

pushing the user's arms through the first and second slits; and conforming the first, second, third, and fourth elastic members to closely engage the user's arms such that ingress of water or other environmental conditions into the interior space through the first and second arm apertures is resisted.

18. The method of claim 17, wherein the personal pop-up pod further includes a harness secured to an inside surface of the enclosure at the rear panel, the harness including a left shoulder strap and a left strip connected to the left shoulder strap, and a right shoulder strap and a right strip connected to the right shoulder strap, and the step of lowering the personal pop-up pod onto the user further comprises:

pulling the left shoulder strap over one shoulder of the user;

pulling the right shoulder strap over another shoulder of the user; and adjusting lengths of the left and right strips to tighten the left and right shoulder straps onto the user and thereby draw the rear panel of the enclosure into engagement with a back of the user, wherein the other panels of the enclosure remain spaced apart from the user in this installed position of the personal pop-up pod.

* * * * *